United States Patent [19]

Mohan et al.

[11] Patent Number: 4,967,039

[45] Date of Patent: Oct. 30, 1990

[54] INSULATING LIQUIDS AND ELECTRIC CABLES

[75] Inventors: Navaratnam C. Mohan, New Malden; Michael J. Poole, London, both of England

[73] Assignee: BICC Public Limited Company, London, England

[21] Appl. No.: 434,479

[22] Filed: Nov. 13, 1989

Related U.S. Application Data

[63] Continuation of Ser. No. 197,316, May 23, 1988, abandoned.

[30] Foreign Application Priority Data

Jun. 18, 1987 [GB] United Kingdom ..... 8714291

[51] Int. Cl.[5] ..... H01B 3/22; H01B 7/02

[52] U.S. Cl. ..... 174/25 C; 252/570; 252/573

[58] Field of Search ..... 252/573, 570; 174/17 LF, 25 C, 25 R

[56] References Cited

U.S. PATENT DOCUMENTS

| | | | |
|---|---|---|---|
| 4,431,578 | 2/1984 | Groenhoe | 252/573 |
| 4,491,684 | 1/1985 | Vecellio | 252/573 |
| 4,556,756 | 12/1985 | Vecellio | 252/570 |

FOREIGN PATENT DOCUMENTS

| | | |
|---|---|---|
| 0001494 | 4/1979 | European Pat. Off. . |
| 1515847 | 6/1978 | United Kingdom . |
| 2120273B | 11/1983 | United Kingdom . |

OTHER PUBLICATIONS

"Standard Methods of Test for D-C Resistance or Conductance of Insulating Materials", ASTM Designation: D 257-66, 1966.

IEEE Specification, 402/1974, 1974.

Electricity Council Engineering Recommendation C28/4, 1975 (amended 1978).

*Primary Examiner*—Paul Lieberman

*Assistant Examiner*—Christine A. Skane

*Attorney, Agent, or Firm*—Oliff & Berridge

[57] ABSTRACT

A silicone base oil for use as impregnant in an electric power cable for fire hazard conditions is rendered non-gassing by the addition of about 2-8% of an aryl alkane having at least two benzene rings spaced apart by not less than one nor more than two aliphatic carbon atoms. The total number of aliphatic carbon atoms in the molecule is limited to six, and the silicone oil should be chosen with a sufficiently high flashpoint for the whole oil to have flashpoint above 150°C. The preferred additive is 1-phenyl 1-(3,4 dimethylphenyl) ethane, also known as PXE.

8 Claims, 1 Drawing Sheet

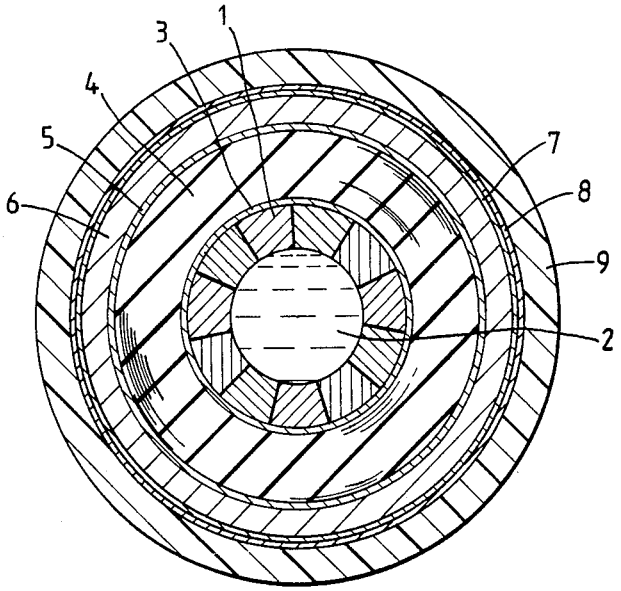
1
2
3
4
5
6
7
8
9

INSULATING LIQUIDS AND ELECTRIC CABLES

This is a continuation of application Ser. No. 197,316 filed May 23, 1988, now abandoned.

This invention relates to insulating liquids for use as impregnants in cables having a dielectric comprising paper, and to the cables in which they are used.

In most cases, the predominant consideration in designing electric cables for the transmission of large amounts of power over long distances is that the aggregate losses in energy from Joule heating in the conductors and dielectric heating in the insulation should be minimised and this indicates the use of high voltages and (except in extreme cases when paper/plastics laminate may be preferred to paper alone) of hydrocarbon impregnants. There are, however, instances where the inherent fire hazard of such impregnants is unacceptable, one such instance being where a cable is installed in a tunnel that is also used for transport purposes (say to make a river or sea crossing).

In such cases, silicone oils (polydialkyl siloxamers) with a flashpoint in the range 150°–300° C. can be used, but the design of cables with silicone impregnants is restricted by the tendency of the silicone oils to develop gas bubbles when exposed to high electrical stresses. There is therefore a need to provide an additive that is gas-absorbing under conditions of electrical stress and which will overcome the gassing tendency of the silicone oil without unduly depressing its flashpoint.

British Patent No. 2120273B describes the use of monoalkyl biphenyls, especially isopropylbiphenyls, for this purpose. We have found another group of useful additives.

In accordance with the invention, a flame-retardant non-gassing insulating oil comprises a silicone base oil and about 2–8% of an arylalkane having at least two benzene rings spaced apart by not less than one nor more than two aliphatic carbon atoms, the total number of aliphatic carbon atoms in the molecule being not more than six, the flashpoint of the silicone oil being sufficiently high for the flashpoint of the whole insulating oil to be above 150° C.

A content less than about 2% is insufficient to eliminate risk of gassing, while a content over 8% needlessly comprises flashpoint. A content of about 5% is considered optimum.

The use of the same aryl alkanes in admixture with silicone oils has been proposed for the control of swelling phenomena in paper/plastics laminate cables (for very high voltages), but the quantity required for that purpose is at least 10% and usually much higher (see published European Patent Application No. 1494 and British Patent No. 1515847 to which the European patent refers) and results in serious depression of flashpoint.

Preferred additives are diphenyl methane, 1,2-dimethylphenyl) and more especially 1-phenyl 1-(3,4-dimethylphenyl) ethane (also known as 1-phenyl 1-xylyl ethane, or PXE for short). PXE is available from Mitsui and Co under the designation "Nisseki Condenser Oils S".

The invention will be further described, by way of example, with reference to the accompanying drawing, which is a diagrammatic cross-section of a cable in accordance with the invention.

A silicone oil of viscosity 20 cSt and flashpoint 224° C. (Rhone Poulenc 47V/20) was mixed with 5% PXE to give a non-gassing insulating oil with the properties shown in Table 1 (in this and subsequent tables "DDB" designates dodecylbenzene, a conventional synthetic hydrocarbon insulating oil, and is included for comparison purposes).

TABLE 1

| PROPERTY | TEST METHOD | OIL OF THE INVENTION | DDB | SILICONE OIL WITH ISOPROPYL DIPHENYL |
|---|---|---|---|---|
| Density at 15° C. (g/cm$^3$) | ASTM D.1298 | 0.96 | 0.87 | |
| Kinematic Viscosity (mm$^2$/s) at | ASTM D.445 | | | |
| 20° C. | | 20.1 | 11.0 | |
| 40° C. | | 14.1 | 6.0 | |
| 60° C. | | 10.3 | 3.5 | |
| Pour Point (°C.) | ASTM D.97 | <−40 | <−55 | <−50 |
| Neutralization Value (mg KOH/g) | ASTM D.974 | 0.0007 | 0.01 | |
| Autogenous Ignition Temperature °C. | ASTM G.72 | >300 | >300 | |
| Specific Heat J/g °C. | Estimate from Published Figures | 0.09 | 0.11 | |
| Coefficient of Expansion (per °C.) | ASTM D.1903 | 0.00093 | 0.00075 | |
| Flashpoint (open Cup) | IP35 | 180 | 140 | 180 |
| Fire Point | IP35 | 284 | 145 | 248 |
| Thermal Conductivity (W/m K) | Estimate from Published Figures | 0.14 | 0.13 | |
| Relative Permittivity | BS 5737 | 2.46 | 2.15 | |
| Breakdown Voltage (kV) | BS 5874 (IEC 156) (Using Filtered Oil) | 53 | 85 | |
| Dissipation Factor at 90° C. and 50 Hz | BS 5737 (IEC 247) | 0.0001 | 0.0001 | |
| Volume Resistivity at 90° C. (Tohm.m) | BS 5737 (IEC 247) | 3200 | 1500 | |
| Gas Absorption under Electrical Stress (mm$^3$/min) | BS 5797 (IEC 628) Method A | 50 | 20 | 41 |

The insulating oil was used as an impregnant in model cables of conventional design (IEEE specification 402-1974 and ASTM 257-66 describe the construction of very similar models that would be expected to give substantially the same measurements) having a central brass mandrel 25 mm in diameter. On the mandrel were applied two metallised carbon paper screening tapes (increasing the diameter to 26.0 mm) followed by 2.8 mm radial thickness of insulating paper tapes each 22 mm wide applied with 30/70 registration at a uniform load of 1N. Dielectric screening was provided by a layer of two embossed metallised carbon paper tapes secured by a polyester foil tape and arranged to form a guard gap of 2.5 mm from the earthed screens of paper stress cones at each end of the model. Based on the average of three tests on model cables in each case, the electrical stress at impulse breakdown with the mandrel negative was 123 kV/mm, compared with 127 kV/mm for DDB impregnated model cables.

Dielectric loss angles were measured for these models at a range of temperatures at 5 kV, with the results shown in table 2 which gives duplicate measurements at each temperature:

| Temperature °C. | Oil of the Invention | DDB |
|---|---|---|
| 20 | 0.00223, 0.00238 | 0.00218, 0.00207 |
| 40 | 0.00209, 0.00225 | 0.00197, 0.00196 |
| 57 | 0.00206, 0.00216 | 0.00192, 0.00193 |
| 80 | 0.00207, 0.00210 | 0.00198, 0.00194 |
| 100 | 0.00248, 0.00250 | 0.00244, 0.00243 |
| 109 | 0.00286, 0.00290 | 0.00297, 0.00296 |

The insulating oil was also used to make a prototype single core cable, in accordance with the accompanying diagrammatic drawing, for service in a 3-phase installation at a system voltage of 132 kV (AC) (the service voltage of the cable in such a system being 76 kV).

Referring to the drawing, the cable comprises a hollow copper conductor 1 with an outside diameter of 19.7 mm and metallic cross-sectional area 185 $mm^2$, defining a central duct 2 which is filled with the insulating oil. Directly applied to the conductor is a conductor screen 3 of carbon paper, with a nominal radial thickness of 0.2 mm. This in turn is surrounded by a paper dielectric 4 with a radial thickness of 8.85 mm (minimum), bringing the nominal diameter to 36.4 mm. The dielectric screen 5 is of aluminium/paper laminate (0.4 mm thick) and sheath 6 of lead alloy 1.8 mm thick, bringing the nominal diameter to 42.8 mm. A bedding 7 of bitumenised cloth tape stainless steel tape reinforcement 8 and an extruded PVC serving (or oversheath) 9 complete a cable 50.1 mm in diameter.

The cable passed a hot impulse test at 95° C. of 640 kV (peak).

Dielectric loss angles were measured at 21° C. and 95° C. at the four voltages specified for the service voltage by Electricity Council Engineering Recommendation C28/4, "Type Approval Test for Impregnated Paper Insulated Gas Pressure and Oil-Filled Power Cable Systems from 33 kV to 132 kV inclusive", with the results shown in table 3; the figures in brackets at 21° C. were measured after 16 hours energisation at 114 kV.

TABLE 3

| Voltage (kV) | 21° C. | 95° C. |
|---|---|---|
| 38 | 0.0024 (0.0025) | 0.0024 |
| 76 | 0.0025 (0.0026) | 0.0025 |
| 114 | 0.0028 (0.0026) | 0.0029 |
| 152 | 0.0033 (0.0029) | 0.0033 |

We claim:

1. A flame-retardant gas-absorbing insulating oil with a flashpoint above 150° C. consisting essentially of a silicone base oil and 2–8% of an aryl alkane having at least two benzene rings spaced apart from one to two aliphatic carbon atoms, the total number of aliphatic carbon atoms in the molecule being from one to six.

2. An oil in accordance with claim 1 wherein substantially 5% of said aryl alkane is present.

3. An oil as claimed in claim 1 in which said aryl alkane is 1-phenyl 1-(3,4-dimethylphenyl) ethane.

4. An oil as claimed in claim 1 in which the aryl alkane is diphenylmethane.

5. An oil as claimed in claim 1 in which said aryl alkane is 1,2 diphenylethane.

6. An electric cable comprising: at least one metallic conductor; insulation surrounding said conductor and comprising paper impregnated with an insulating oil; and a fluid tight sheath enclosing said conductor and said insulation, wherein said insulating oil consisting essentially of a silicone base oil and 2–8% of an aryl alkane having at least two benzene rings spaced apart by from one to two carbon atoms, the total number of aliphatic carbon atoms in the molecule being from one to six.

7. An electric cable as claimed in claim 6 in which said diaryl alkane is 1-phenyl 1-(3,4 dimethylphenyl) ethane.

8. An electric cable as claimed in claim 7 in which said insulating oil comprises substantially 5% of said diaryl alkane.

* * * * *

UNITED STATES PATENT AND TRADEMARK OFFICE

CERTIFICATE OF CORRECTION

PATENT NO. : 4,967,039

DATED : October 30, 1990

INVENTOR(S) : Navaratnam C. MOHAN et al.

It is certified that error appears in the above-identified patent and that said Letters Patent is hereby corrected as shown below:

Column 2, line 5, change "comprises" to --compromises--.

Column 3, line 42, after "tape" insert --,-- . (1st occurrence)

Column 4, line 36 (Claim 6, line 5), change "consisting" to --consists--.

Signed and Sealed this

Sixteenth Day of June, 1992

*Attest:*

DOUGLAS B. COMER

*Attesting Officer*

*Acting Commissioner of Patents and Trademarks*